US005219014A

United States Patent [19]

Mazeran

[11] Patent Number: 5,219,014

[45] Date of Patent: Jun. 15, 1993

[54] DEVICE AND METHOD FOR FABRICATING FOUNDRY MOLDS FROM GRANULAR MATERIAL

[76] Inventor: Jean-Jacques Mazeran, 2bis, rue Jean Jaurés, F-51000 Chalons Sur Marne, France

[21] Appl. No.: 824,075

[22] Filed: Jan. 23, 1992

[30] Foreign Application Priority Data

Feb. 1, 1991 [FR] France ..... 91 01180

[51] Int. Cl.[5] ..... B22C 15/22

[52] U.S. Cl. ..... 164/7.2; 164/7.1; 164/39; 164/160.1; 164/160.2; 164/203

[58] Field of Search ..... 164/7.1, 7.2, 15, 18, 164/37, 38, 39, 160.1, 166.2, 167, 169, 195, 203

[56] References Cited

U.S. PATENT DOCUMENTS 3,952,793 4/1976 Hijikata et al. ..... 164/57
4,940,071 7/1990 Mazeran ..... 164/7.2

FOREIGN PATENT DOCUMENTS 0126269 11/1984 European Pat. Off. .
2352492 4/1975 Fed. Rep. of Germany .
3318112 11/1984 Fed. Rep. of Germany ..... 164/169
2307596 11/1976 France .
2618358 1/1989 France .

*Primary Examiner*—Richard K. Seidel
*Assistant Examiner*—Erik R. Puknys
*Attorney, Agent, or Firm*—Harrison & Egbert

[57] ABSTRACT

The invention concerns a device and method for continuous fabricating of foundry molds from granular material.

The device consists of a frame (10) with lights (11) supporting through swivels (31) caissons (30, 40) with large partitions (42) provided with grooves (421) into which pattern-plates (60) are inserted, and with small partitions (43) provided with suction holes (431); the caissons being connected to a vacuum source through flexible hoses controlled by solenoid valves; the whole assembly being placed after heat-forming of a polymer film (92) around a grid (70) with a hollow rib (74) and filter (741) connected to a vacuum source through a connector (75).

7 Claims, 3 Drawing Sheets

DEVICE AND METHOD FOR FABRICATING FOUNDRY MOLDS FROM GRANULAR MATERIAL

TECHNICAL FIELD

This invention concerns a device and method for continuous fabricating of foundry molds from granular material.

BACKGROUND ART

The French patent application No. 2 307 596 describes a foundry molding box in which a device for feeding and recovering the granular material is provided for. Such device consists of a volume approximately in the shape of a truncated cone whose smaller base is equipped with a trap door through which the filling tube can be inserted; such trap door is airtight and remains closed for the whole duration of the box operation. Upon completion of the molding, the vacuum is broken as the box is turned over and the door trap opens, thus letting the material fall out by gravity.

Such a device and such a method allow only for slow molding rates as numerous handling operations prove necessary. Furthermore, casting is carried out with the mold maintained in the two molding boxes, which ties up two costly boxes to produce one single mold. In addition, it is necessary to carry out twice the forming operation in order to obtain the upper and lower parts of the mold in order for this dual operation to result in a complete mold.

A device and method permitting to eliminate in part those disadvantages as described in the French patent application No. 87 10514 are already well-known. The device in question differs from similar ones in the sense that it is made of at least two pattern-plates placed in the corresponding housings of a support, and of at least one sealing plate and one grid with two faces. The pattern-plate supporting components and the sealing plates are hinged with one another. The polymer film is a single film which corresponds to the surface area of the sealing plates and pattern-plates.

The method consists mainly of preparing the pattern-plates in the support, laying on top of such plates a polymer coating through heat-forming and suction through the plates, installing the pattern-plates around a grid with no more than three faces, ensuring the tightness between the polymer film and the grid by shrinking the film between the grid and the plates, or by applying the film onto the grid through pressure-sealing, filling with granular material, welding together the ends of said sheath over the upper grid and bringing together the cakes thus obtained to make prints.

This device and this method enable to achieve movements with reduced handling operations. In addition, only the grid and polymer sheath are used at the casting station and the grid is much simpler than the boxes previously used, thus resulting in a rather low investment. Furthermore, one single operation is sufficient to obtain both parts of a mold, which improves the output by close to 50%. The process is semi-continuous, but the casting can be continuous by juxtaposing the cakes. The number of parts required is small, just like the volume of granular material used.

However, the use of a two-face grid does not lend itself very well to roller handling and the length of stroke and size of the masses to be moved limits its performance. The device and method under the invention aim at correcting these disadvantages by proposing a pattern-plate support with sliding and pivoting caissons connected to a vacuum source, capable of lying flat against the grid after interposition of a polymer film, with the upper parts of said film being applied against the top of the grid under the action of air pressure and depression.

SUMMARY OF THE INVENTION

The device under the invention is mainly characterized by the fact that the pattern-plate support mainly consists of two caissons with partitions each connected to a vacuum source and capable of sliding and pivoting toward each other in relation to a frame surrounding a vibrating table on which a three-face grid connected to the vacuum source is placed.

The large partition of each caisson is made to the dimensions of a pattern-plate which closes the caisson when inserted into a groove provided for that purpose in the edge of the opening of said caisson.

The small partition of each caisson is fully enclosed and features air holes in the wall located in prolongation of the pattern-plate.

The width of the small partition is determined according to the width of the grid and is equal to approx. $\frac{2}{3}$ of the latter.

The caissons slide and pivot through two swivels placed laterally in the median plane of each caisson and through guide lights mounted in the upper part of the frame.

The grid is made of three faces of a rectangular parallelogram on which the top face is missing and the vertical faces, connected by a hollow central rib covered with a micro-perforated filter, feature each, in addition to a filtering device, a vacuum connector equipped with a check valve, a working pin, a supporting shoe for fastening onto the vibrating table and a machined surface designed to be used as geometrical reference for the molded castings.

The process to bring the device under the invention into operation is mainly characterized by the fact that, after having placed the frame around the vibrating table, it consists of:

- putting the caissons in the horizontal position,
- inserting a pattern-plate into each groove of the large partitions of each caisson,
- heat-forming on each pattern-plate a plastic film sticking out on the top of each small partition of the caissons,
- connecting the two partitions of each caisson to the vacuum source by actuating the solenoid valves,
- possibly spraying on the surface of each film a non-sticky product,
- placing the grid on the vibrating table after having moved aside and tilted the caissons in the vertical position,
- laying the pattern-plates flat against the grid by sliding the swivels in the guide lights of the frame,
- connecting the caissons to the vibrating table, either directly, or through an intermediary frame,
- filling with granular material the space left between the two pattern-plates with the vibrating table in operation,
- pressurizing the small partition of each caisson to the atmospheric pressure by actuating the solenoid valves, folding back each end of the plastic film covering each caisson small partition against the top of the sand cake, connecting the grid hollow rib to the vacuum source in order to stiffen the cake, breaking the vacuum in the large partitions of the caissons using the associated solenoid valves and moving back said partitions to release the grid, discharging the cake towards the casting line while maintaining the grid under partial vacuum.

bringing the caissons back into the horizontal position for a new cycle.

The advantages offered by this invention consist mainly of the fact that due to the reduction of the moving masses and strokes, performances are improved. The presence of a bottom face on the grid also makes handling easier.

Other features and advantages will be shown in the following description of the device implemented according to the invention process and given as a non-limiting example on the basis of the attached drawings in which:

DETAILED DESCRIPTION OF THE INVENTION

Figure 1:
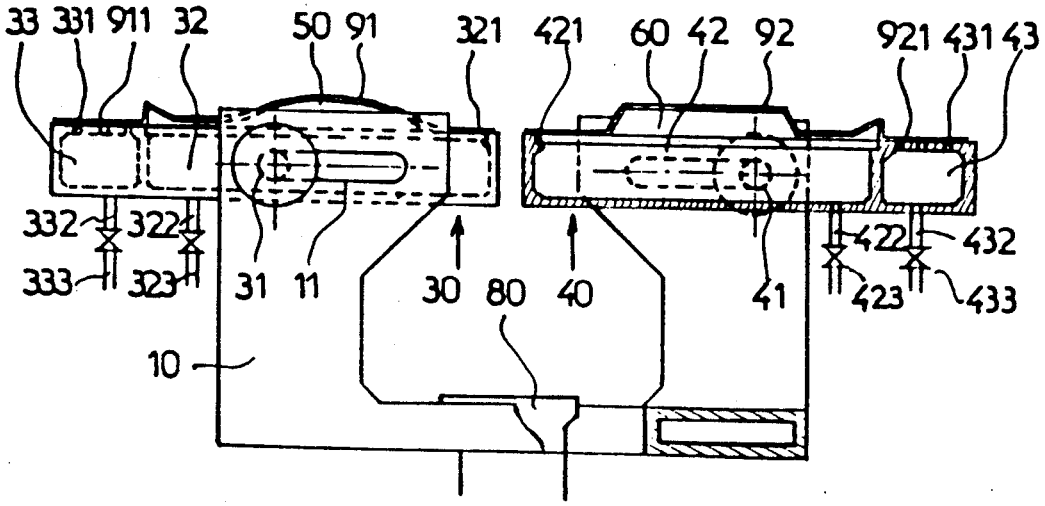
FIG. 1 represents the device in its starting position with the plastic film in place.

The figures represent a device for the continuous fabrication of foundry molds from granular material under the invention featuring a frame 10 with lights 11, supporting through swivels 31, 41 caissons 30 and 40 with large partitions 32, 42 provided with grooves 321, 421 in which pattern-plates 50, 60 are inserted, and with small partitions 33, 43 provided with suction holes 331, 431; said caissons being connected to a vacuum source through central flexible hoses 322, 422 and 332, 432 and through solenoid valves 323, 423, 333, 433, respectively; the whole assembly being placed around a grid 70 with sides 71, 72, 73 joined through a hollow rib 74 with micro-perforated filter 741, connected to the vacuum source through a connector 75 provided with working pins, supporting shoes 77 and a machined surface 78.

A closer examination of FIGS. 1 through 4 shows that the horizontal position of caissons 30 and 40 allows for easy insertion of pattern-plates 50 and 60 into grooves 321 and 421 of the large partitions 32 and 42 and easy application of a polymer film 91, 92 onto the pattern-plates and onto the small partitions 33 and 43 due to the partial vacuum applied in all partitions through flexible hoses 222, 422, 332, 432 upon actuation of solenoid valves 323, 423, 333, 433. The spraying of a product on the surface of the polymer film, followed by quick drying, is also made that much easier by this horizontal presentation.

Figure 2:
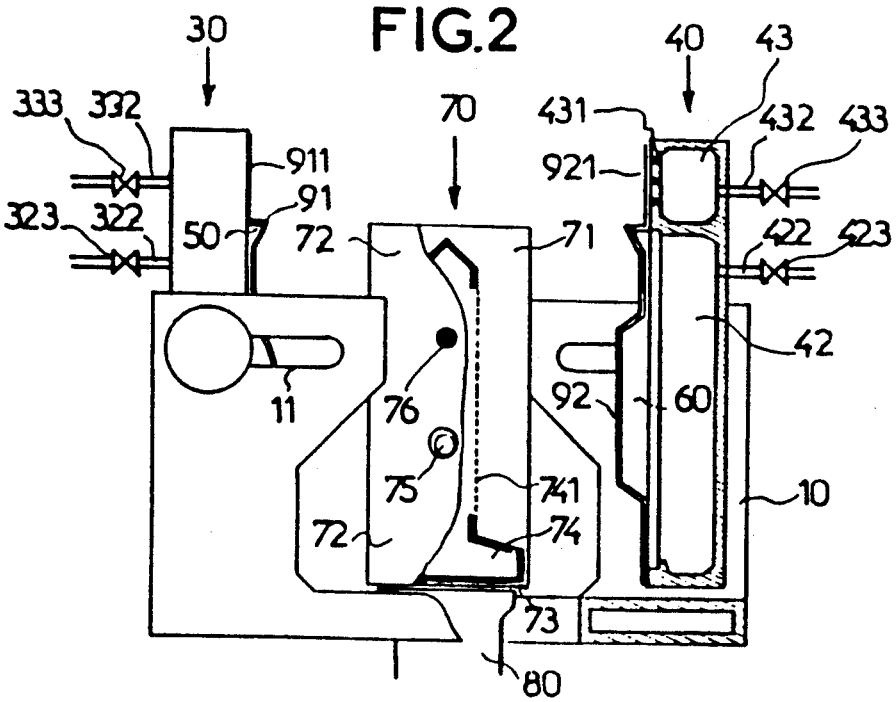
FIG. 2 represents the second step of the process which is the tilting of the pattern-plates into the vertical position and the installation of the grid.
Figure 3:
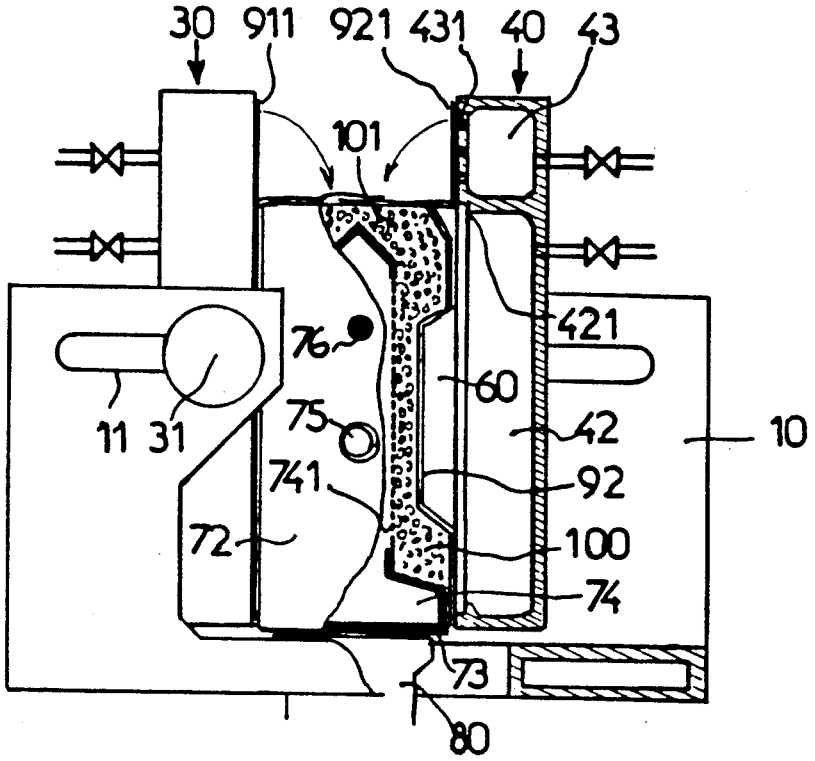
FIG. 3 represents the third step of the process which is the bringing together of the pattern-plates and the folding back of the film end.
Figure 4:
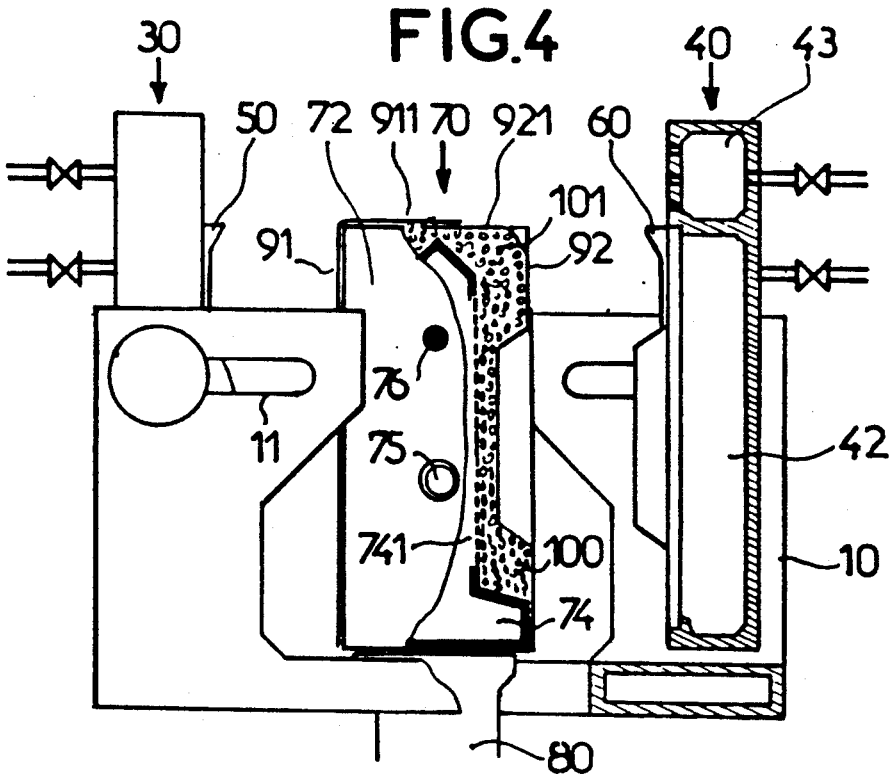
FIG. 4 represents the last step of the process which is the release of the grid by moving back the pattern-plates after the cake has been formed.
Figure 5:
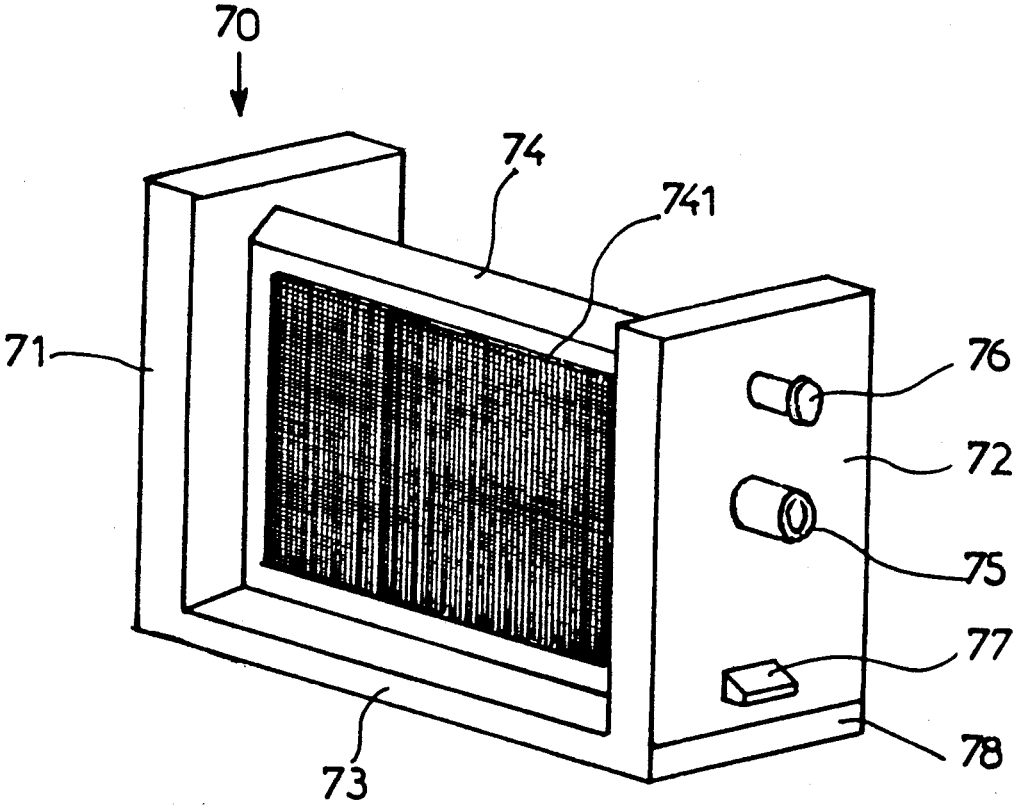
FIG. 5 represents a view in perspective of the grid.

The presence of swivels 31 and 41 on the sides of caissons 30 and 40 and the insertion of said swivels into lights 11 of frame 10 make it possible, as shown on FIGS. 2 through 4, to easily tilt and slide caissons 30 and 40 supporting pattern-plates 50 and 60, thus being able to be brought together or moved apart in relation to grid 70 resting through its base 73 on the vibrating table 80.

When looking more specifically at FIG. 3, it can be noted that, provided that the vacuum in small partitions 33 and 43 of the caissons has first been broken, ends 911 and 921 of the polymer films can be folded back onto the upper part 101 of the granular material cake 100 while superimposing the edges before applying the vacuum in hollow rib 74 of the grid through connectors 75, and after starting the vibrating table once the space between the pattern-plates has been filled with granular material.

I claim:

1. A device for fabricating foundry molds from granular material comprising:

a frame extending around a vibrating table;

a grid having no more than three faces, said grid positioned within said frame on said vibrating table, at least one of said faces adapted for receiving granular material thereagainst;

a vacuum source means operatively connected to said grid so as to apply a vacuum to the face adapted for receiving granular material;

a support having a plurality of caissons and a plurality of partitions, each of said partitions arranged within each of said caissons, said vacuum means operably connected to said caissons so as to supply a vacuum within said caissons, each of said caissons slidable and pivotable relative to said frame; and a plurality of pattern-plates positioned on a surface of said caissons of said support, each of said plurality of pattern-plates and caissons movable toward at least one face of said grid.

2. The device according to claim 1, said plurality of partitions comprising a large partition positioned in each of said plurality of caissons, said large partition is made to dimensions of a pattern-plate, said pattern-plate closes said large partition when inserted into a groove in the edge of an opening of said large partition.

3. The device according to claim 1, said plurality of partitions comprising a small partition within each caisson, said small partition is fully enclosed and has a wall having a plurality of air holes extending outwardly of said pattern-plate.

4. The device according to claim 3, a width of the small partition of each caisson is equal to approximately $\frac{2}{3}$ of a width of the grid.

5. The device according to claim 1, said caissons slide and pivot through swivels mounted laterally in a median plane of each caisson, said swivels extending through horizontal guide lights provided in an upper part of said frame.

6. The device according to claim 1, said grid having three faces of a rectangular parallelogram in which the top face is missing, said grid having vertical faces joined through a central hollow rib covered with a micro-perforated filter.

7. A process of fabricating foundry molds comprising the steps of:

placing a frame on a vibrating table, said frame pivotably and slidably supporting a plurality of caissons therein;

putting the caissons in a horizontal position;

inserting a pattern-plate into a groove formed in large partitions of the caissons;

heat-forming a plastic film on each pattern-plate a plastic film so as to stick out on a top of small partitions of the caissons;

connecting the large and small partitions of each caisson to a vacuum source by actuating solenoid valves;

placing on a vibrating table after moving aside and tilting the caissons in a vertical position;

laying the pattern-plates flat against the grid by sliding swivels of the caissons in lights formed in a frame supporting the caissons;

connecting the caissons to the vibrating table;

filling with granular material a space between the pattern-plates while the vibrating table is vibrating;

pressurizing the small partitions of the caissons to atmospheric pressure by actuating the solenoid valves;

folding back each end of the plastic film covering the small partition of each caisson against a top of the granular material;

connecting a hollow rib of the grid to the vacuum source in order to cake the granular material;

breaking the vacuum in the large partitions of the caissons through the solenoid valves and moving back the large partitions so as to release from the grid;

discharging the caked granular material towards a casting line while maintaining the grid under partial vacuum; and bringing the caissons back into the horizontal position.

* * * * *